US006061846A

United States Patent [19]

Peterson

[11] Patent Number: 6,061,846

[45] Date of Patent: May 16, 2000

[54] BATHTUB WALK-THROUGH INSERT

[75] Inventor: Craig S. Peterson, Salt Lake City, Utah

[73] Assignee: Bathcrest, Inc, Salt Lake City, Utah

[21] Appl. No.: 09/226,285

[22] Filed: Jan. 7, 1999

[51] Int. Cl.[7] ..... A47K 3/02

[52] U.S. Cl. ..... 4/555

[58] Field of Search ..... 4/538, 555, 584

[56] References Cited

U.S. PATENT DOCUMENTS 5,628,851 5/1997 Lawler ..... 4/555 X

*Primary Examiner*—Robert M. Fetsuga

[57] ABSTRACT

A bathtub walk-through insert to be positioned and bonded into a cut-out opening in a sidewall of a bathtub, the insert is generally U-shaped, with a web that will rest on a bottom of the cut out opening and legs that will fit against the opposite ends of the cut-out opening.

2 Claims, 1 Drawing Sheet

BATHTUB WALK-THROUGH INSERT

BRIEF DESCRIPTION OF THE INVENTION

1. Field of the Invention

This invention relates to bathtubs and particularly to methods and apparatus for providing a finished cut-out in an exposed sidewall of a bathtub.

2. Prior Art

It is well recognized that elderly persons and those with disabilities often have a difficult time getting into and out of bathtubs. For such persons the sidewall of the tub can become an insurmountable hurdle. Even with the assistance of a health aide many such persons cannot safely step over the sidewall of a bathtub and into the bathtub to take a bath or shower. Consequently, these persons often have to forego taking a bath or shower and settle for alternate bathing methods, such as sponge baths and the like. Most people do not find the alternative bathing methods satisfactory.

Of course, expensive remodeling of the bathtub area, with removal of the bathtub and installation of a walk-in shower may provide a showering system that does not require a user stepping over the sidewall of a bathtub. This, however is a very costly and time consuming method of solving the problems.

OBJECTS OF THE INVENTION

Principal objects of the present invention are to provide a method of and apparatus for reducing the height of step required for a person to step into a bathtub enclosure preparatory to taking a shower or bath within the bathtub enclosure.

Other objects are to provide a bathtub sidewall insert that is economical to build and to install, that requires a minimum of installation time and skilled labor for installation and that will retain the attractive character of the bathtub.

Still other objects are to provide bathtub sidewall insert usable with most existing bathtubs and that is safe for persons being bathed, as well as assistants helping with the bathing procedure.

FEATURES OF THE INVENTION

Principal features of the invention include a method of facilitating entry into and exit from a bathtub enclosure that involves cutting out a portion of a sidewall of a bathtub and then fitting a pre-made insert into the cut opening and bonding such insert in place in the opening cut for the purpose, thereby reducing the height of the modified tub sidewall in the area of the insert.

The pre-made insert is sized to fit into openings formed in a wide variety of bathtubs and is made of an acrylic plastic, or other suitable material that is durable and that will have an appearance corresponding to or enhancing the appearance of the bathtub itself. The insert is molded, with a hollow interior, interior faces of the legs flared from the web, and outer faces of the legs extending at right angles with respect to the web.

Additional objects and features of the invention will become apparent to those skilled in the art to which the invention pertains from the following detailed description and drawings.

THE DRAWINGS

In the Drawings:

FIG. 1 is a perspective view of the bathtub walk-through insert of the invention;

FIG. 2, an exploded view of a bathtub wall, cut out to receive a bathtub walkthrough insert and a bathtub walk-through insert to be mounted in the cut out bathtub wall; and FIG. 3, a perspective view of a section of a bathtub wall with a walk-through insert positioned in a cut out section of the bathtub wall.

DETAILED DESCRIPTION

Figure 1:
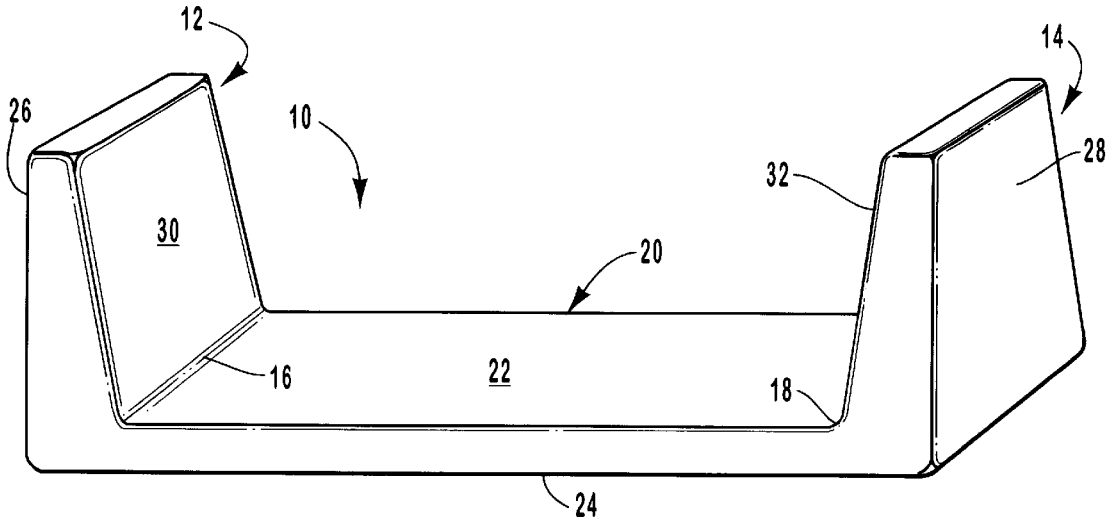
Figure 2:
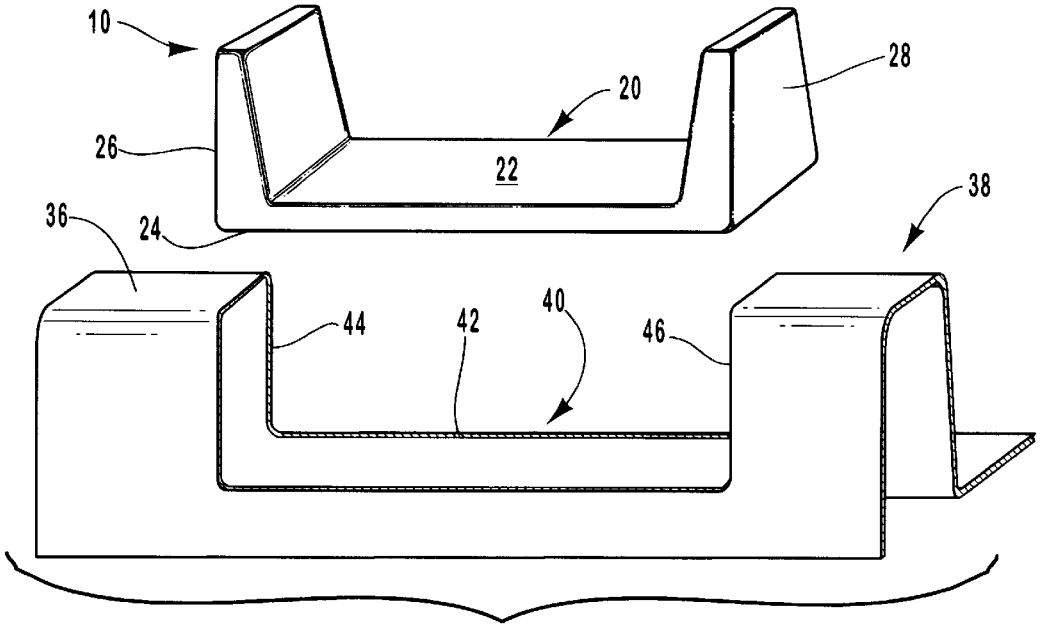
Figure 3:
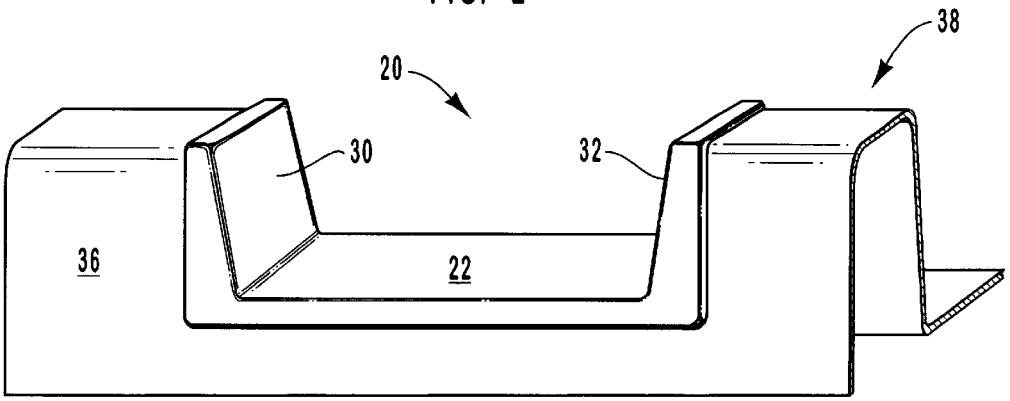

Referring now to the drawings:

In the illustrated preferred embodiment a bathtub walk-through insert is shown at 10. Insert 10 is made of a single piece and is of generally U-shape, including a pair of legs 12 and 14, respectively projecting from opposite ends 16 and 18 of a web 20.

Insert 10 is preferably made from acrylic plastic or other suitable strong material and is formed with a hollow interior. The exterior surface of the insert is made smooth and the web 20 has straight, parallel, top and bottom surfaces 22 and 24.

Outer leg surfaces 26 and 28 of the legs 12 and 14, respectively, extend at right angles with respect to the top and bottom surfaces 22 and 24 of the web 20. Inner leg surfaces 30 and 32 of the legs 12 and 14, respectively, however, may be angled outwardly from the web to provide a more attractive appearance to a modified bathtub.

In practice, a sidewall 36 of a bathtub 38 is cut away to form an opening 40 extending from the top of the tub to just above the bottom of the tub and that will closely receive the insert 10, with the web 20 extending across a bottom 42 of the opening 40 and the legs 12 and 14 at opposite ends 44 and 46 of the opening 40. A waterproof adhesive (not shown) is applied to the outer leg surfaces 26 and 28, to the ends of the opening 40 and to the bottom surface 24 before the insert is positioned in the opening and is allowed to set-up and to permanently secure the insert in the tub opening. Once the insert has been positioned a user can readily step into the tub without having to step over a tub sidewall and can then take a shower or a shallow tub bath, as desired. Water can be retained in the bathtub to a level just below the top surface 22 of web 20 to be used for a shallow bath, if desired.

Although a preferred form of my invention has been herein disclosed it is to be understood that the disclosure is by way of example and that variations are possible without departing from the subject matter coming within the scope of the following claims, which subject matter I regard as my invention.

I claim:

1. A method of providing a bathtub with a walk through insert in a sidewall thereof comprising cutting an opening through a sidewall of a bathtub extending for a portion of the length of the sidewall and from the top of said sidewall to just above the bottom of the tub, with a bottom edge of said opening extending parallel to an elongate top surface of said sidewall and edges at opposite ends of said opening being parallel to one another and forming right angles with the bottom edge;

forming a generally U-shaped hollow insert of plastic material having an elongate web with a straight, flat bottom surface and legs having straight, flat end surfaces projecting at right angles to said bottom surface of said web and from opposite ends of said web; and bonding said insert to said bathtub sidewall, with said elongate, straight, flat bottom surface of said web of said insert resting on said bottom edge of said opening and said straight, flat end surfaces of said legs of said insert engaging opposite ends of said opening.

2. A bathtub walk-through insert comprising a generally U-shaped, one piece plastic body having a hollow web with a length that is a portion of the length of a sidewall of a bathtub and an elongate, flat, bottom surface and hollow legs projecting from a face of the web at opposite ends of said web, each said leg having a flat outer surface extending at a right angle with respect to said elongate, flat, bottom surface of said web to engage an end edge of an opening through the bathtub sidewall when the body is positioned in the opening with the web resting on a bottom of the opening and ends of the legs remote from the web aligned with a top surface of the sidewall.

* * * * *